US011139638B2

(12) United States Patent
Yamakawa et al.

(10) Patent No.: US 11,139,638 B2
(45) Date of Patent: Oct. 5, 2021

(54) STATIC CHARGE ELIMINATOR AND STATIC CHARGE ELIMINATION METHOD

(71) Applicant: Mitsubishi Electric Corporation, Tokyo (JP)

(72) Inventors: Kyohei Yamakawa, Tokyo (JP); Tomoya Hirata, Tokyo (JP); Ryota Iriki, Tokyo (JP); Takafumi Oka, Tokyo (JP); Kenji Yoshikawa, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 41 days.

(21) Appl. No.: 16/347,876

(22) PCT Filed: Nov. 30, 2017

(86) PCT No.: PCT/JP2017/043060
§ 371 (c)(1),
(2) Date: May 7, 2019

(87) PCT Pub. No.: WO2018/110296
PCT Pub. Date: Jun. 21, 2018

(65) Prior Publication Data

US 2019/0356115 A1 Nov. 21, 2019

(30) Foreign Application Priority Data

Dec. 13, 2016 (JP) ..... JP2016-241166

(51) Int. Cl.
*B65H 16/00* (2006.01)
*H01T 19/04* (2006.01)
(Continued)

(52) U.S. Cl.
CPC ..... *H01T 19/04* (2013.01); *B65H 16/00* (2013.01); *B05D 3/14* (2013.01); *B41J 13/10* (2013.01);
(Continued)

(58) Field of Classification Search
CPC . H01T 9/04; B65H 16/00; H02H 1/00; B05D 3/14; G03G 15/00; B41J 13/10; B41J 13/18; B41J 13/16; B41J 11/0015
(Continued)

(56) References Cited

U.S. PATENT DOCUMENTS 4,517,143 A 5/1985 Kisler
5,842,087 A * 11/1998 Matsushita ..... G03G 15/0216 399/174
2009/0324842 A1* 12/2009 Tanaka ..... B05D 7/04 427/471

FOREIGN PATENT DOCUMENTS

JP S56037400 U 1/1981
JP H2129900 A 5/1990
(Continued)

OTHER PUBLICATIONS

International Search Report (PCT/ISA/210) and Written Opinion (PCT/ISA/237) dated Feb. 13, 2018, by the Japanese Patent Office as the International Searching Authority for International Application No. PCT/JP2017/043060.
(Continued)

*Primary Examiner* — Danny Nguyen
(74) *Attorney, Agent, or Firm* — Buchanan Ingersoll & Rooney PC

(57) ABSTRACT

The static charge eliminator includes a charger including one or more charging units, and a grounded needle-shaped conductor. The charger is configured to charge an insulating film such that the absolute value of the surface potential of
(Continued)

the insulating film is 3 kV or more. The needle-shaped conductor is arranged to generate a corona discharge between the needle-shaped conductor and the insulating film charged by the charger. Thereby, the static charges on the insulating film can be reliably eliminated.

14 Claims, 5 Drawing Sheets

(51) Int. Cl.

| | |
|---|---|
| *B05D 3/14* | (2006.01) |
| *G03G 15/00* | (2006.01) |
| *B41J 13/10* | (2006.01) |
| *B41J 13/18* | (2006.01) |
| *B41J 13/16* | (2006.01) |

(52) U.S. Cl.
CPC ..... *B41J 13/16* (2013.01); *B41J 13/18* (2013.01); *G03G 15/00* (2013.01)

(58) Field of Classification Search
USPC ..... 361/212, 220
See application file for complete search history.

(56) References Cited

FOREIGN PATENT DOCUMENTS

| | | | |
|---|---|---|---|
| JP | H0864384 | A | 3/1996 |
| JP | 2006019043 | A | 1/2006 |
| JP | 4251762 | B2 | 4/2009 |
| JP | 2009196774 | A | 9/2009 |
| JP | 2011180641 | A | 9/2011 |

OTHER PUBLICATIONS

Office Action dated Mar. 10, 2020, issued in corresponding Japanese Patent Application No. 2018-556559, 8 pages including 4 pages of English translation.

Office Action dated Sep. 11, 2020, by the German Patent Office in corresponding German Patent Application No. 112017006247.0 and English translation of the Office Action. (13 pages).

* cited by examiner

STATIC CHARGE ELIMINATOR AND STATIC CHARGE ELIMINATION METHOD

TECHNICAL FIELD

The present invention relates to a static charge eliminator and a static charge elimination method.

BACKGROUND ART

A self-discharge type static charge eliminator is disclosed in Japanese Patent No. 4251762 (PTL 1).

CITATION LIST

Patent Literature

PTL 1: Japanese Patent No. 4251762

SUMMARY OF INVENTION

Technical Problem

However, when the absolute value of the surface potential of an insulating film to be neutralized is low, the self discharge may not occur between the insulating film and the static charge eliminator, and thereby, it is impossible to use the self-discharge type static charge eliminator to eliminate the static charges on the insulating film. The present invention has been made in view of the problem mentioned above, and it is an object of the present invention to provide a self-discharge type static charge eliminator and a static charge elimination method capable of reliably eliminating the static charges on the insulating film.

Solution to Problem

The static charge eliminator of the present invention includes a charger including at least one charging unit, and a grounded needle-shaped conductor. The charger is configured to charge an insulating film by contacting the insulating film such that the absolute value of the surface potential of the insulating film is 3 kV or more. The needle-shaped conductor is arranged to generate a corona discharge between the insulating film charged by the charger and the needle-shaped conductor.

The static charge elimination method of the present invention includes charging an insulating film by bringing a charger into contact with a surface of the insulating film such that the absolute value of the surface potential of the insulating film is 3 kV or more, and generating a corona discharge between a grounded needle-shaped conductor and the charged insulating film.

Advantageous Effects of Invention

In the static charge eliminator of the present invention, the charger is configured to charge an insulating film by contacting the insulating film such that the absolute value of the surface potential of the insulating film is 3 kV or more. Therefore, it is possible to reliably generate a corona discharge between the grounded needle-shaped conductor and the insulating film. According to the static charge eliminator of the present invention, the static charges on the insulating film can be reliably eliminated.

In the static charge elimination method of the present invention, the insulating film is charged by bringing the charger into contact with a surface of the insulating film such that the absolute value of the surface potential of the insulating film is 3 kV or more. Therefore, it is possible to reliably generate a corona discharge between the grounded needle-shaped conductor and the insulating film. According to the static charge elimination method of the present invention, the static charges on the insulating film can be reliably eliminated.

DESCRIPTION OF EMBODIMENTS

Figure 1:
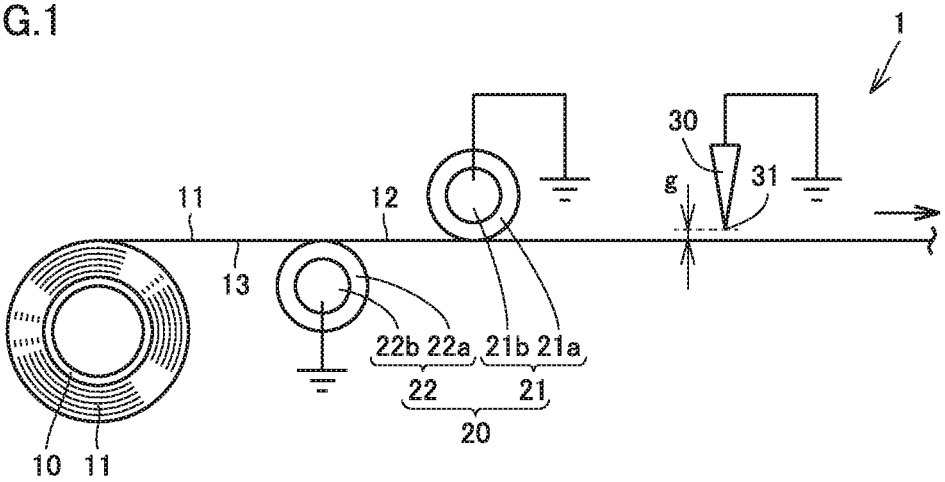
FIG. 1 is a schematic view illustrating a static charge eliminator according to a first embodiment of the present invention.

Embodiments of the present invention will be described hereinafter. The same components will be denoted by the same reference numerals, and the description thereof will not be repeated.

First Embodiment

Figure 2:
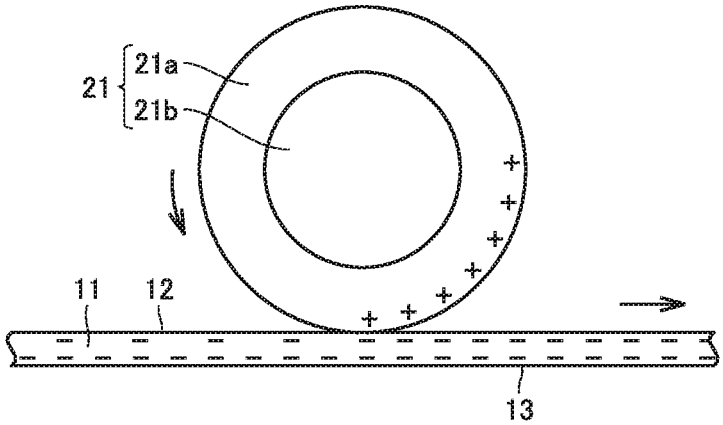
FIG. 2 is an enlarged schematic view illustrating a part of the static charge eliminator according to the first embodiment of the present invention.
Figure 3:
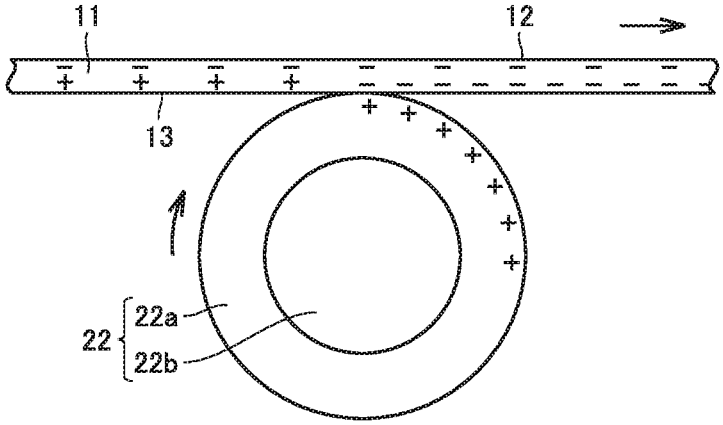
FIG. 3 is an enlarged schematic view illustrating a part of the static charge eliminator according to the first embodiment of the present invention.

A static charge eliminator 1 according to a first embodiment will be described with reference to FIGS. 1 to 3. The static charge eliminator 1 of the present embodiment includes a charger 20 and a grounded needle-shaped conductor 30. The static charge eliminator 1 of the present embodiment may further include a bobbin 10 around which the insulating film 11 is wound.

The insulating film 11 has a first surface 12 and a second surface 13 opposite to the first surface 12. The insulating film 11 is not particularly limited, it may be a plastic film such as a polyethylene terephthalate (PET) film, a polyester film, a polyethylene film, a polypropylene film, a polyvinyl chloride film, a polyimide film, a nylon film, or it may be a piece of paper. The insulating film 11 is wound around the bobbin 10, and may be stored as a film roll. Although not particularly limited, the bobbin 10 may be made of an insulating material such as paper or resin, or a conductive material such as metal.

The absolute value of the surface potential of the insulating film 11 before being conveyed to the charger 20 is less than 3 kV. The absolute value of the surface potential of the insulating film 11 before being conveyed to the charger 20 may be, for example, 2 kV or more and less than 3 kV. In the present specification, the surface potential of the insulating film 11 is defined as a potential caused by the first charges on the first surface 12 and the second charges on the second surface 13. When the insulating film 11 is unwound from the bobbin 10, the insulating film 11 is peeled off from the adjacent insulating film 11 or rubs against the adjacent insulating film 11 or is peeled off from the adjacent insulating film 11 while rubbing against the adjacent insulating film 11. Thus, for example, the first charges having a first polarity (for example, a negative polarity) are formed on the first surface 12, and the second charges having a second polarity (for example, a positive polarity) opposite to the first polarity are formed on the second surface 13. The amount of the second charges is substantially equal to the amount of the first charges. Therefore, the absolute value of the surface potential of the insulating film 11 before being conveyed to the charger 20 is small.

The charger 20 is disposed downstream of the bobbin 10 in the conveying direction of the insulating film 11. The insulating film 11 is conveyed to the charger 20. The charger 20 includes one or more charging units (21, 22). The charger 20 may include a plurality of charging units (21, 22). One or more charging units (21, 22) are configured to charge the insulating film 11. At least one (for example, a first charging unit 21) of the plurality of charging units (21, 22, 23) may be arranged to face one surface (for example, the first surface 12), and the rest (for example, a second charging unit 22, a third charging unit 23) of the plurality of charging units (21, 22, 23) may be arranged to face the other surface (for example, the second surface 13).

Figure 4:
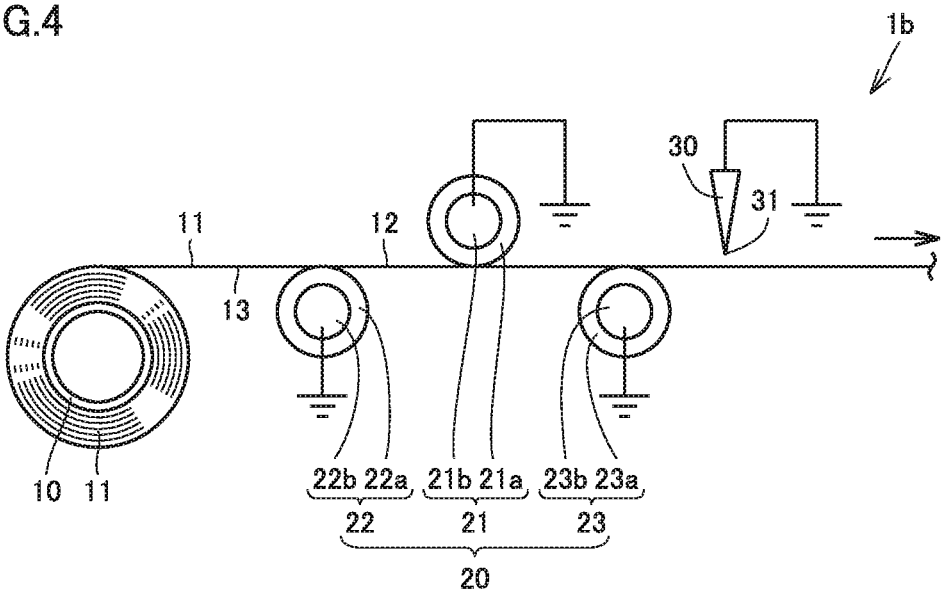
FIG. 4 is a schematic view illustrating a static charge eliminator according to a modification of the first embodiment of the present invention.

In the static charge eliminator 1 of the present embodiment, the charger 20 includes two charging units (a first charging unit 21 and a second charging unit 22). The first charging unit 21 is arranged to face the first surface 12 of the insulating film 11, and the second charging unit 22 is arranged to face the second surface 13 of the insulating film 11. As illustrated in FIG. 4, in a static charge eliminator 1*b* according to a modification of the present embodiment, the charger 20 may include three charging units (a first charging unit 21, a second charging unit 22, and a third charging unit 23). The first charging unit 21 is arranged to face the first surface 12 of the insulating film 11, and the second charging unit 22 and the third charging unit 23 are arranged to face the second surface 13 of the insulating film 11.

Each of one or more charging units (21, 22, 23) includes an insulating member 21*a*, 22*a*, 23*a*. Each insulating member 21*a*, 22*a*, 23*a* is configured to contact a surface (at least one of the first surface 12 and the second surface 13) of the insulating film 11. The insulating members 21*a*, 22*a*, 23*a* may be made of the same material. The insulating member (for example, the insulating member 21*a*) included in at least one (for example, the first charging unit 21) of the plurality of charging units (21, 22, 23) may be made of a different material from the insulating member (for example, the insulating member 22*a*, the insulating member 23*a*) included in the rest (for example, the second charging unit 22, the third charging unit 23) of the plurality of charging units (21, 22, 23).

The insulating members 21*a*, 22*a*, 23*a* are made of a material having a different level in the triboelectric series from the insulating film 11. For example, the insulating members 21*a*, 22*a*, 23*a* may be made of a material having a higher level in the triboelectric series than the insulating film 11. Specifically, the insulating film 11 may be made of a material having a relatively lower level in the triboelectric series, and the insulating members 21*a*, 22*a*, 23*a* may be made of a material having a relatively higher level in the triboelectric series. As an example, the insulating film 11 may be made of polyethylene terephthalate (PET), and the insulating members 21*a*, 22*a*, 23*a* may be made of glass or silicone rubber. When a material has a relatively lower level in the triboelectric series, it means that the material is relatively easy to be negatively charged, and when a material has a relatively higher level in the triboelectric series, it means that the material is relatively easy to be positively charged. As illustrated in FIGS. 2 and 3, when the insulating members 21*a*, 22*a*, and 23*a* are made of a material having a higher level in the triboelectric series than the insulating film 11, both surfaces (the first surface 12 and the second surface 13) of the insulating film 11 are negatively charged by one or more charging units (21, 22, 23).

For example, the insulating members 21*a*, 22*a*, 23*a* may be made of a material having a lower level in the triboelectric series than the insulating film 11. Specifically, the insulating film 11 may be made of a material having a relatively higher level in the triboelectric series, and the insulating members 21*a*, 22*a*, 23*a* may be made of a material having a relatively lower level in the triboelectric series. As an example, the insulating film 11 may be made of nylon, and the insulating members 21*a*, 22*a*, 23*a* may be made of natural rubber or vinyl chloride. As another example, the insulating film 11 may be made of paper, and the insulating members 21*a*, 22*a*, 23*a* may be made of Teflon (registered trademark). When the insulating members 21*a*, 22*a*, 23*a* are made of a material having a lower level in the triboelectric series than the insulating film 11, both surfaces (first surface 12 and second surface 13) are positively charged by one or more charging units (21, 22, 23).

Each of the one or more charging units (21, 22, 23) includes a roller 21*b*, 22*b*, 23*b* covered by the insulating member 21*a*, 22*a*, 23*a*. The rollers 21*b*, 22*b*, 23*b* may have the same diameter. At least two of the rollers 21*b*, 22*b*, 23*b* may have a diameter different from each other. When the insulating film 11 is being conveyed, the rollers 21*b*, 22*b*, 23*b* covered by the insulating members 21*a*, 22*a*, 23*a* are made to rotate in such a manner that the insulating members 21*a*, 22*a*, 23*a* are brought into contact with a surface (at least one of the first surface 12 and the second surface 13) of the insulating film 11. Alternatively, when the insulating film 11 is being conveyed, the rollers 21*b*, 22*b*, 23*b* covered by the insulating members 21*a*, 22*a*, 23*a* may be made to rotate in such a manner that the insulating members 21*a*, 22*a*, 23*a* are brought into contact with both surfaces (the surface 12 and the second surface 13) of the insulating film 11. Specifically, when the insulating film 11 is being conveyed, the rollers 21*b*, 22*b*, 23*b* covered by the insulating members 21*a*, 22*a*, 23*a* may be made to rotate in such a manner that the insulating member 21*a* is brought into contact with the first surface 12 of the insulating film 11 and the insulating members 22*a* and 23*a* are brought into contact with the second surface 13 of the insulating film 11.

The rollers 21*b*, 22*b*, 23*b* may be conductive. The rollers 21*b*, 22*b*, 23*b* may be made of a metal material such as stainless steel or aluminum. The rollers 21*b*, 22*b*, 23*b* may be grounded. After the insulating members 21*a*, 22*a*, 23*a* are brought into contact with the insulating film 11, the insulating members 21*a*, 22*a*, 23*a* are peeled off from the insulating film 11, or rub against the insulating film 11, or are peeled from the insulating film 11 while rubbing against the insulating film 11. Therefore, after the insulating film 11 is conveyed to pass through each of the one or more charging units (21, 22, 23), the insulating members 21*a*, 22*a*, 23*a* are charged with static charges having a polarity opposite to that of the insulating film 11. At least a part of the static charges accumulated in the insulating members 21*a*, 22*a*, 23*a* can be eliminated by the grounded rollers 21*b*, 22*b*, 23*b*.

The charger 20 is configured to charge the insulating film 11 such that the absolute value of the surface potential of the insulating film 11 is 3 kV or more. For example, it is possible for the charger 20 to charge the insulating film 11 such that the absolute value of the surface potential of the insulating film 11 is 3 kV or more by appropriately setting the material of the insulating film 11, the materials of the insulating members 21*a*, 22*a*, 23*a*, the contact pressure between the insulating film 11 and the insulating members 21*a*, 22*a* and 23*a*, the contact length between the insulating film 11 and the insulating members 21*a*, 22*a* and 23*a*, and the number of one or more charging units (21, 22, 23) included in the charger 20.

The charger 20 may be configured to charge the insulating film 11 such that the absolute value of the surface potential of the insulating film 11 is 30 kV or less. The charger 20 may be configured to charge the insulating film 11 such that the absolute value of the surface potential of the insulating film 11 is 20 kV or less. For example, it is possible for the charger 20 to charge the insulating film 11 such that the absolute value of the surface potential of the insulating film 11 is 30 kV or less or 20 kV or less by appropriately setting the material of the insulating film 11, the materials of the insulating members 21*a*, 22*a*, 23*a*, the contact pressure between the insulating film 11 and the insulating members 21*a*, 22*a* and 23*a*, the contact length between the insulating film 11 and the insulating members 21*a*, 22*a* and 23*a*, and the number of one or more charging units (21, 22, 23) included in the charger 20.

In one example, the insulating film 11 is made of polyethylene terephthalate (PET), and the insulating members 21*a*, 22*a*, 23*a* are made of glass. In this example, the absolute value of the surface potential of the insulating film 11 charged by the charger 20 is 18 kV to 20 kV.

The needle-shaped conductor 30 is disposed downstream of the charger 20 in the conveying direction of the insulating film 11. The needle-shaped conductor 30 is a conductor having a tip 31 facing the insulating film 11. The needle-shaped conductor 30 may include one tip 31 or a plurality of tips 31. The needle-shaped conductor 30 is not particularly limited, it may be a conductive cord or a conductive brush. The needle-shaped conductor 30 is not particularly limited, it may include a conductive material such as stainless steel, copper, brass, aluminum or titanium.

The needle-shaped conductor 30 is grounded. The needle-shaped conductor 30 is arranged to generate a corona discharge between the insulating film 11 charged by the charger 20 and the needle-shaped conductor 30. A gap g between the needle-shaped conductor 30 and the insulating film 11 may be 5 cm or less or may be 2 cm or less, for example. The corona discharge is generated by the potential difference between the insulating film 11 charged by the charger 20 and the needle-shaped conductor 30. The grounded needle-shaped conductor 30 constitutes a self-discharge type static charge eliminator.

The corona discharge generates ions in the vicinity of the first surface 12 and the second surface 13 of the insulating film 11 near the needle-shaped conductor 30 by ionizing air around the needle-shaped conductor 30. Among the generated ions, those ions having a polarity opposite to the polarity of the static charges on both surfaces (the first surface 12 and the second surface 13) of the insulating film 11 after passing through the charger 20 are attracted to both surfaces (the first surface 12 and the second surface 13) of the insulating film 11. Thus, the static charges on both surfaces (the first surface 12 and the second surface 13) of the insulating film 11 are neutralized by those ions, and thereby, the static charges on the insulating film 11 are eliminated.

Figure 5:
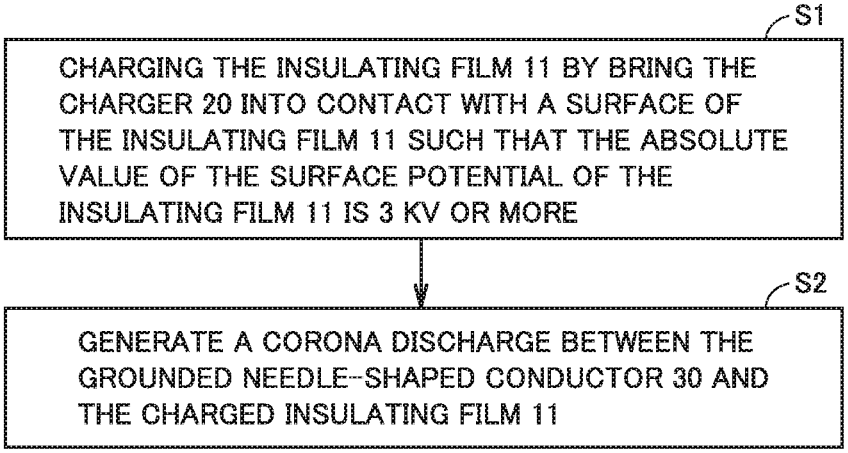
FIG. 5 is a flowchart illustrating a static charge elimination method according to the first embodiment of the present invention.

A static charge elimination method according to the first embodiment and its modification will be described with reference to FIG. 5. The static charge elimination method of the present embodiment includes charging the insulating film 11 such that the absolute value of the surface potential of the insulating film 11 is 3 kV or more (S1). Charging the insulating film 11 (S1) may include bringing the insulating members 21*a*, 22*a*, 23*a* into contact with a surface (at least one of the first surface 12 and the second surface 13) of the insulating film 11. The static charge elimination method of the present embodiment further includes generating a corona discharge between the grounded needle-shaped conductor 30 and the charged insulating film 11 (S2).

The effects of the static charge eliminator 1, 1*b* and the static charge elimination method of the present embodiment and its modification will be described.

The static charge eliminator 1, 1*b* according to the present embodiment and its modification includes a charger 20 including at least one charging unit (21, 22, 23) and a grounded needle-shaped conductor 30. The charger 20 is configured to charge the insulating film 11 by contacting the insulating film 11 such that the absolute value of the surface potential of the insulating film 11 is 3 kV or more. The needle-shaped conductor 30 is arranged to generate a corona discharge between the insulating film 11 charged by the charger 20 and the needle-shaped conductor 30.

The charger 20 charges the insulating film 11 by contacting the insulating film 11 such that the absolute value of the surface potential of the insulating film 11 is 3 kV or more. Therefore, it is possible to reliably generate a corona discharge between the grounded needle-shaped conductor 30 and the insulating film 11. According to the static charge eliminator 1, 1*b* of the present embodiment and its modification, the static charges on the insulating film 11 can be reliably eliminated.

Usually, when a power supply is required in an environment with explosion-proof requirements, the required power supply should be explosion proof, which makes it large in size. However, in the static charge eliminator 1 or 1*b* of the present embodiment, the static charges on the insulating film 11 may be eliminated without using a power supply. Thus, the static charge eliminator 1 or 1*b* of the present embodiment can be easily introduced into such an environment at a low cost. Further, in the static charge eliminator 1, 1*b* of the present embodiment and its modification, no power supply is needed for delivering the insulating film 11. Therefore, there is no limitation on the delivering speed of the insulating film 11 due to the power supply, and the delivering speed of the insulating film 11 can be set freely.

According to the static charge eliminator 1, 1*b* of the present embodiment and its modification, the static charges on the insulating film 11 can be reliably eliminated, which make it possible to prevent foreign matters present in the circumstance of the insulating film 11 (for example, in the air around the insulating film 11) from being adhered to the insulating film 11 by the static charges. From the viewpoint of preventing the adhesion of foreign matters to the insulating film 11, there is no need to completely eliminate the static charges on the insulating film 11, and the static charges on the insulating film 11 should be eliminated to such an extent that foreign matters will not be adhered to the insulating film 11 by the static charges.

In the static charge eliminator 1, 1*b* of the present embodiment and its modification, the grounded needle-shaped conductor 30 is arranged in such a manner that a corona discharge may be generated between the needle-shaped conductor 30 and the insulating film 11. The grounded needle-shaped conductor 30 constitutes a self-discharge type static charge eliminator. According to the static charge eliminator 1, 1*b* of the present embodiment and its modification, the corona discharge may be generated between the needle-shaped conductor 30 and the insulating film 11 without applying a high voltage to the needle-shaped conductor 30. Therefore, the static charge eliminator 1, 1*b* according to the present embodiment and its modification may be used without any additional equipments in a working environment (such as a process of manufacturing a coil which includes a step of covering a conductor with the insulating film 11) which is required to prevent sparks from occurring.

In the static charge eliminator 1, 1*b* of the present embodiment and its modifications, one or more charging units (21, 22, 23) each include a roller 21*b*, 22*b*, 23*b* covered by the insulating member 21*a*, 22*a*, 23*a* having a different level in the triboelectric series from the insulating film 11. The insulating member 21*a*, 22*a*, 23*a* may be configured to contact a surface (at least one of the first surface 12 and the second surface 13) of the insulating film 11. According to the static charge eliminator 1, 1*b* of the present embodiment and its modification, the insulating film 11 may be charged to such an extent that a corona discharge may be reliably generated between the grounded needle-shaped conductor 30 and the insulating film 11 simply by bringing the insulating member 21*a*, 22*a*, 23*a* into contact with a surface (at least one of the first surface 12 and the second surface 13) of the insulating film 11.

In the static charge eliminator 1, 1*b* of the present embodiment and its modification, one or more charging units (21, 22, 23) may be a plurality of charging units (21, 22, 23). The amount of static charges on the insulating film 11 may be increased by using the plurality of charging units (21, 22, 23) to charge a surface (at least one of the first surface 12 and the second surface 13) of the insulating film 11. The charger 20 may charge the insulating film 11 such that the absolute value of the surface potential of the insulating film 11 is surely 3 kV or more.

In the static charge eliminator 1, 1*b* of the present embodiment and its modification, the surface of the insulating film 11 includes one surface (for example, the first surface 12) of the insulating film 11 and the other surface (for example, the second surface 13) opposite to the one surface (for example, the first surface 12). At least one (for example, the first charging unit 21) of the plurality of charging units (21, 22, 23) may face the one surface (for example, the first surface 12), and the rest (for example, the second charging unit 22, the third charging unit 23) of the plurality of charging units (21, 22, 23) may face the other surface (for example, the second surface 13). According to the static charge eliminator 1, 1*b* of the present embodiment and its modification, the static charges on both surfaces (the first surface 12 and the second surface 13) of the insulating film 11 can be reliably eliminated.

In the static charge eliminator 1, 1*b* of the present embodiment and its modification, the insulating member (for example, the insulating member 21*a*) included in at least one (for example, the first charging unit 21) of the plurality of charging units (21, 22, 23) may be made of a different material from the insulating member (for example, the insulating member 22*a*, the insulating member 23*a*) included in the rest (for example, the second charging unit 22, the third charging unit 23) of the plurality of charging units (21, 22, 23). Thus, even though both surfaces (the first surface 12 and the second surface 13) of the insulating film 11 are made of different materials from each other, it is possible to charge the insulating film 11 such that the absolute value of the surface potential of the insulating film 11 is surely 3 kV or more.

For example, the first surface 12 of the insulating film 11 may be charged by bringing the insulating member (for example, the insulating member 21*a*) included in at least one (for example, the first charging unit 21) of the plurality of charging units (21, 22, 23) into contact with the first surface 12 of the insulating film 11, and the second surface 13 of the insulating film 11 may be charged by bringing the insulating member (for example, the insulating member 22*a*, the insulating member 23*a*) included in the rest (for example, the second charging unit 22, the third charging unit 23) of the plurality of charging units (21, 22, 23) into contact with the second surface 13 of the insulating film 11. Thus, even though both surfaces (the first surface 12 and the second surface 13) of the insulating film 11 are made of different materials from each other, it is possible to charge the insulating film 11 such that the absolute value of the surface potential of the insulating film 11 is surely 3 kV or more. According to the static charge eliminator 1, 1*b* of the present embodiment and its modification, the static charges on both surfaces (the first surface 12 and the second surface 13) of the insulating film 11 can be reliably eliminated.

In the static charge eliminator 1, 1*b* of the present embodiment and its modification, one or more charging units (21, 22, 23) each may include a roller 21*b*, 22*b*, 22*c* covered by the insulating member 21*a*, 22*a*, 23*b*. According to the static charge eliminator 1, 1*b* of the present embodiment and its modification, since the insulating film 11 can be charged while being conveyed, the static charges on the insulating film 11 can be eliminated efficiently.

In the static charge eliminator 1 or 1*b* of the present embodiment and its modification, the charger 20 may be configured to charge the insulating film 11 such that the absolute value of the surface potential of the insulating film 11 is 30 kV or less. Therefore, it is possible to prevent the insulating film 11 from being imparted with excessive static charges by the charger 20. According to the static charge eliminator 1, 1*b* of the present embodiment and its modification, the static charges imparted to the insulating film 11 by the charger 20 may be eliminated in a short time by the grounded needle-shaped conductor 30.

The static charge elimination method of the present embodiment and its modification includes charging the insulating film 11 by bringing the charger 20 into contact with a surface (at least one of the first surface 12 and the second surface 13) of the insulating film 11 such that the absolute value of the insulating film 11 is 3 kV or more (S1), and generating a corona discharge between the grounded needle-shaped conductor 30 and the charged insulating film 11 (S2).

In the static charge elimination method of the present embodiment and its modification, the insulating film 11 is charged by bringing the charger 20 into contact with a surface (at least one of the first surface 12 and the second surface 13) of the insulating film 11 such that the absolute value of the insulating film 11 is 3 kV or more. Therefor, it is possible to reliably generate a corona discharge between the grounded needle-shaped conductor 30 and the insulating film 11. According to the static charge elimination method of the present embodiment and its modification, the static charges on the insulating film 11 can be reliably eliminated.

In the static charge elimination method of the present embodiment and its modification, the corona discharge is generated between the grounded needle-shaped conductor 30 and the charged insulating film 11. The grounded needle-shaped conductor 30 constitutes a self-discharge type static charge eliminator. In the static charge elimination method of the present embodiment and its modification, it is not necessary to apply a high voltage to the needle-shaped conductor 30 so as to generate a corona discharge between the needle-shaped conductor 30 and the insulating film 11. Therefore, the static charge elimination method of the present embodiment and its modification may be used in a work environment (for example, a process of manufacturing a coil which includes a step of covering a conductor with the insulating film 11) which is required to prevent sparks from occurring.

In the static charge elimination method of the present embodiment and its modification, charging the insulating film 11 includes bringing the insulating member 21*a*, 22*a*, 23*a* having a different level in the triboelectric series from the insulating film 11 into contact with a surface (at least one of the first surface 12 and the second surface 13) of the insulating film 11. According to the static charge elimination method of the present embodiment and its modification, the insulating film 11 may be charged to such an extent that a corona discharge may be reliably generated between the grounded needle-shaped conductor 30 and the insulating film 11 simply by bringing the insulating member 21*a*, 22*a*, 23*a* into contact with a surface (at least one of the first surface 12 and the second surface 13) of the insulating film 11.

Second Embodiment

Figure 6:
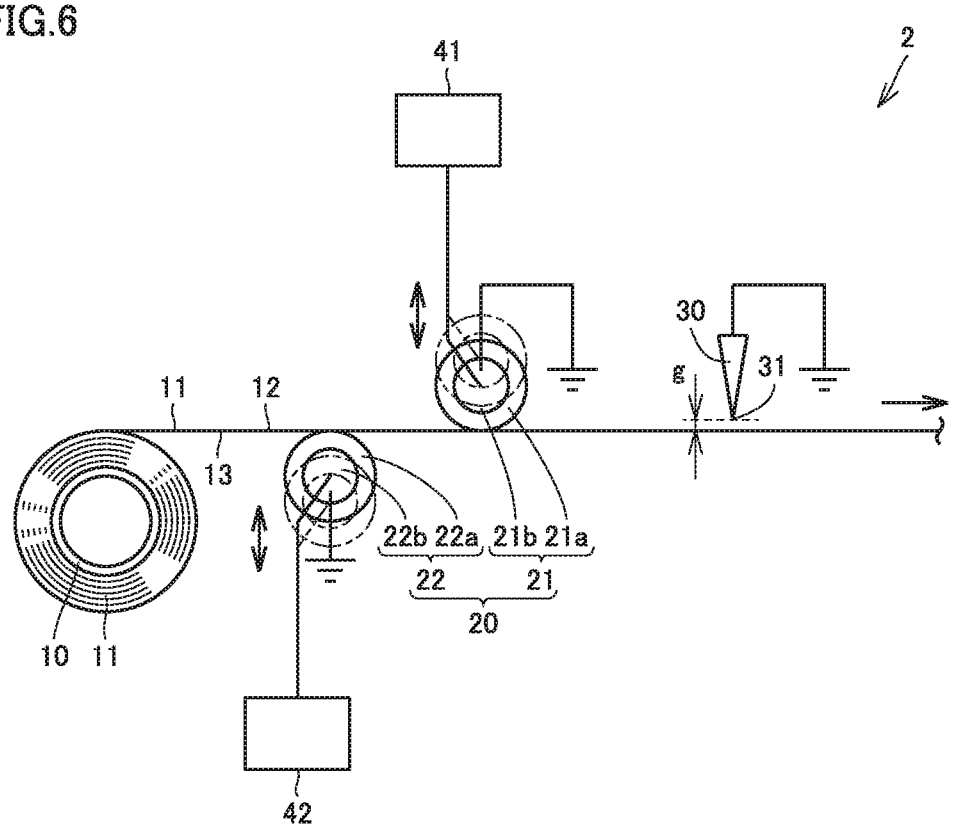
FIG. 6 is a schematic view illustrating a static charge eliminator according to a second embodiment of the present invention.

A static charge eliminator 2 according to a second embodiment will be described with reference to FIG. 6. The static charge eliminator 2 of the present embodiment has substantially the same configuration as the static charge eliminator 1 of the first embodiment except the following points.

In the static charge eliminator 2 of the present embodiment, one or more charging units (21, 22) are a plurality of charging units (21, 22). At least one of the plurality of charging units (21, 22) is configured to be switchable between a first state (indicated by a solid line in FIG. 6) in which the at least one of the plurality of charging units (21, 22) charges the insulating film 11 and a second state (indicated by a two-dot chain line in FIG. 6) in which the at least one of the plurality of charging units (21, 22) imparts no static charge to the insulating film 11. Specifically, in the first state, the insulating members 21*a*, 22*a* are brought into contact with the insulating film 11, and in the second state, the insulating members 21*a*, 22*a* are separated from the insulating film 11. In the second state, both the contact pressure and the contact length between the insulating member 21*a*, 22*a* and the insulating film 11 are zero.

Specifically, at least one of the plurality of charging units (21, 22) is connected to a drive unit (41, 42). The drive unit (41, 42) is configured to move at least one of the plurality of charging units (21, 22) in a direction crossing a surface (at least one of the first surface 12 and the second surface 13) of the insulating film 11. More specifically, the first drive unit 41 is connected to the first charging unit 21, more specifically to the roller 21*b*. The first drive unit 41 is configured to move the first charging unit 21, more specifically the roller 21*b* in a direction crossing a surface (at least one of the first surface 12 and the second surface 13) of the insulating film 11. The second drive unit 42 is connected to the second charging unit 22, more specifically to the roller 22*b*. The second drive unit 42 is configured to move the second charging unit 22, more specifically the roller 22*b* in a direction crossing a surface (at least one of the first surface 12 and the second surface 13) of the insulating film 11.

The first drive unit 41 is configured to move the first charging unit 21 in a direction crossing a surface (at least one of the first surface 12 and the second surface 13) of the insulating film 11. Specifically, the first drive unit 41 may be configured to move the roller 21*b* in a direction orthogonal to the first surface 12 of the insulating film 11. The insulating member 21*a* covered on the roller 21*b* may be movable in a direction crossing a surface (at least one of the first surface 12 and the second surface 13) of the insulating film 11. Specifically, the insulating member 21*a* covered on the roller 21*b* may be movable in a direction orthogonal to the first surface 12 of the insulating film 11.

The second drive unit 42 is configured to move the second charging unit 22 in a direction crossing a surface (at least one of the first surface 12 and the second surface 13) of the insulating film 11. Specifically, the second drive unit 42 may be configured to move the roller 22*b* in a direction orthogonal to the second surface 13 of the insulating film 11. The insulating member 22*a* covered on the roller 22*b* may be movable in a direction crossing a surface (at least one of the first surface 12 and the second surface 13) of the insulating film 11. Specifically, the insulating member 22*a* covered on the roller 22*b* may be movable in a direction orthogonal to the second surface 13 of the insulating film 11.

According to the static charge eliminator 2 of the present embodiment, the insulating film 11 may be charged such that the absolute value of the surface potential of the insulating film 11 is surely 3 kV or more. For example, when only one charging unit (for example, the first charging unit 21) is used to charge the insulating film 11, it may be difficult to charge the insulating film 11 such that the absolute value of the surface potential of the insulating film 11 is 3 kV or more. In this case, the drive unit (for example, the second drive unit 42) is used to bring the other charging unit (for example, the second charging unit 22) into contact with the insulating film 11 so as to switch the charging unit 22 to the first state in which charging unit 22 charges the insulating film 11. Thus, the insulating film 11 is charged by the one charging unit (for example, the first charging unit 21) and the other charging unit (for example, the second charging unit 22). Specifically, the insulating film 11 is contacted by the one insulating member (for example, the insulating member 21*a*) and the other insulating member (for example, the insulating member 22*a*). Thus, according to the static charge eliminator 2, the insulating film 11 may be charged such that the absolute value of the surface potential of the insulating film 11 is surely 3 kV or more. Therefore, it is possible to use the static charge eliminator 2 to reliably eliminate the static charges on the insulating film 11.

According to the static charge eliminator 2 of the present embodiment, the insulating film 11 may be charged such that the absolute value of the surface potential of the insulating film 11 is surely 30 kV or less. For example, when all of the charging units (for example, the first charging unit 21 and the second charging unit 22) are used to charge the insulating film 11, the absolute value of the surface potential of the insulating film 11 may exceed 30 kV. In this case, a drive unit (for example, the second drive unit 42) is used to move at least one charging unit (for example, the second charging unit 22) away from the insulating film 11 so as to switch the second charging unit 22 to the second state in which the second charging unit 22 imparts no static charge to the insulating film 11. Thus, the insulating film 11 is charged only by one charging unit (for example, the first charging unit 21). Specifically, only one insulating member (for example, the insulating member 21*a*) is brought into contact with the insulating film 11. Thus, according to the static charge eliminator 2, the insulating film 11 may be charged such that the absolute value of the surface potential of the insulating film 11 is surely 30 kV or less, whereby it is possible to prevent the insulating film 11 from being imparted with excessive static charges by the charger 20. Therefore, the static charges imparted to the insulating film 11 by the charger 20 may be eliminated in a short time by the grounded needle-shaped conductor 30.

The insulating member (for example, the insulating member 21*a*) included in one or more (for example, the first charging unit 21) of the plurality of charging units (21, 22) may be made of a different material from the insulating member (for example, the insulating member 22*a*) included in the rest (for example, the second charging unit 22) of the plurality of charging units (21, 22).

According to the static charge eliminator 2 of the present embodiment, the insulating film 11 may be charged such that the absolute value of the surface potential of the insulating film 11 is surely 3 kV or more and 30 kV or less. For example, when one charging unit (for example, the first charging unit 21) is used to charge the insulating film 11, it may be difficult to charge the insulating film 11 such that the absolute value of the surface potential of the insulating film 11 is 3 kV or more and 30 kV or less. In this case, the other charging unit (for example, the second charging unit 22) is used to charge the insulating film 11 in place of the one charging unit (for example, the first charging unit 21). Specifically, a drive unit (for example, the first drive unit 41) is used to move one charging unit (for example, the first charging unit 21) away from the insulating film 11 so as to switch the first charging unit 21 to the second state in which the first charging unit 21 imparts no static charge to the insulating film 11, and meanwhile, another drive unit (for example, the second drive unit 42) is used to bring the other charging unit (for example, the second charging unit 22) into contact with the insulating film 11 so as to switch the second charging unit 22 to the first state in which the second charging unit 22 the insulating film 11. Thereby, the insulating film 11 is charged by using the other charging unit (for example, the second charging unit 22) in place of the one charging unit (for example, the first charging unit 21). Specifically, instead of one insulating member (for example, the insulating member 21*a*), the insulating film 11 is contacted by the other insulating member (for example, the insulating member 22*a*) which is made of a material different from the one insulating member. Thus, according to the static charge eliminator 2, the insulating film 11 may be charged such that the absolute value of the surface potential of the insulating film 11 is surely 3 kV or more and 30 kV or less. Therefore, it is possible for the static charge eliminator 2 to reliably eliminate the static charges on the insulating film 11 in a short time.

In addition to the effects of the static charge eliminator 1 of the first embodiment, the static charge eliminator 2 of the present embodiment provide the following effects.

In the static charge eliminator 2 of the present embodiment, one or more charging units (21, 22) are a plurality of charging units (21, 22). At least one of the plurality of charging units (21, 22) is configured to be switchable between a first state in which the at least one of the plurality of charging units (21, 22) charges the insulating film 11 and a second state in which the at least one of the plurality of charging units (21, 22) imparts no static charge to the insulating film 11. According to the static charge eliminator 2 of the present embodiment, the static charges on the insulating film 11 can be reliably eliminated.

In the static charge eliminator 2 of the present embodiment, the insulating members 21*a*, 22*a* may be configured to be movable in a direction crossing a surface (at least one of the first surface 12 and second surface 13) of the insulating film 11. Therefore, the insulating film 11 may be charged while being conveyed. According to the static charge eliminator 2 of the present embodiment, the static charges on the insulating film 11 can be reliably eliminated in a short time.

In the static charge eliminator 2 of the present embodiment, the insulating member (for example, the insulating member 21*a*) included in one or more (for example, the first charging unit 21) of the plurality of charging units (21, 22) may be made of a different material from the insulating member (for example, the insulating member 22*a*) included in the rest (for example, the second charging unit 22) of the plurality of charging units (21, 22). According to the static charge eliminator 2 of the present embodiment, the static charges on the insulating film 11 can be reliably eliminated in a short time.

Third Embodiment

A static charge eliminator 3 and a static charge elimination method according to a third embodiment will be described with reference to FIGS. 7 and 8. The static charge eliminator 3 of the present embodiment has substantially the same configuration as the charge removing device 1 of the first embodiment and the static charge elimination method of the present embodiment includes substantially the same steps as the static charge elimination method of the first embodiment except the following points.

In the static charge eliminator 3 of the present embodiment, at least one of the one or more charging units (21, 22) is configured such that at least one of a contact pressure and a contact length between the insulating member 21*a*, 22*a* and the insulating film 11 is changed. In the static charge elimination method of the present embodiment, charging the insulating film 11 includes changing at least one of the contact pressure and the contact length between the insulating member 21*a*, 22*a* and the insulating film 11.

At least one of the one or more charging units (21, 22) is connected to a drive unit (41, 42). The drive unit (41, 42) is configured to move at least one of the one or more charging units (21, 22) in a direction crossing a surface (at least one of the first surface 12 and the second surface 13) of the insulating film 11. The first charging unit 21, specifically the roller 21*b* is connected to the first drive unit 41, and the second charging unit 22, specifically the roller 22*b* is connected to the second drive unit 42.

The first drive unit 41 is configured to move the first charging unit 21 in a direction crossing a surface (at least one of the first surface 12 and the second surface 13) of the insulating film 11. Specifically, the first drive unit 41 may be configured to move the roller 21*b* in a direction orthogonal to the first surface 12 of the insulating film 11. The insulating member 21*a* covered on the roller 21*b* may be movable in a direction crossing a surface (at least one of the first surface 12 and the second surface 13) of the insulating film 11. Specifically, the insulating member 21*a* covered on the roller 21*b* may be movable in a direction orthogonal to the first surface 12 of the insulating film 11.

The second drive unit 42 is configured to move the second charging unit 22 in a direction crossing a surface (at least one of the first surface 12 and the second surface 13) of the insulating film 11. Specifically, the second drive unit 42 may be configured to move the roller 22*b* in a direction orthogonal to the second surface 13 of the insulating film 11. The insulating member 22*a* covered on the roller 22*b* may be movable in a direction crossing a surface (at least one of the first surface 12 and the second surface 13) of the insulating film 11. Specifically, the insulating member 22*a* covered on the roller 22*b* may be movable in a direction orthogonal to the second surface 13 of the insulating film 11.

The drive unit (for example, the first drive unit 41) may be configured to move at least one (for example, the first charging unit 21) of the one or more charging units (21, 22) so that at least one (for example, the first charging unit 21) of the one or more charging units (21, 22) presses the insulating film 11 in a first direction crossing the conveying direction of the insulating film 11. The drive unit (for example, the second drive unit 42) may be configured to move at least one (for example, the second charging unit 22) of the one or more charging units (21, 22) so that at least one (for example, the second charging unit 22) of the one or more charging units (21, 22) presses the insulating film 11 in a second direction which is opposite to the first direction and crossing the conveying direction of the insulating film 11. At least one of the contact pressure and the contact length between the insulating member 21*a*, 22*a* included in one or more charging units (21, 22) and the insulating film 11 may be changed by changing the moving distance of one or more charging units (21, 22).

According to the static charge eliminator 3 of the present embodiment, the insulating film 11 may be charged such that the absolute value of the surface potential of the insulating film 11 is surely 3 kV or more. For example, in the case of increasing the amount of static charges imparted to the insulating film 11 by the charger 20, at least one of the one or more charging units (21, 22) may be moved so as to increase at least one of the contact pressure and the contact length between the insulating member 21*a*, 22*a* included in one or more charging units (21, 22) and the insulating film 11. Thus, according to the static charge eliminator 3, the insulating film 11 may be charged such that the absolute value of the surface potential of the insulating film 11 is surely 3 kV or more. Therefore, the static charges on the insulating film 11 may be reliably eliminated by the grounded needle-shaped conductor 30.

According to the static charge eliminator 3 of the present embodiment, the insulating film 11 may be charged such that the absolute value of the surface potential of the insulating film 11 is surely 30 kV or less. For example, in the case of decreasing the amount of static charges imparted to the insulating film 11 by the charger 20, at least one of the one or more charging units (21, 22) may be moved so as to decrease at least one of the contact pressure and the contact length between the insulating member 21*a*, 22*a* included in one or more charging units (21, 22) and the insulating film 11. Therefore, it is possible to prevent the insulating film 11 from being imparted with excessive static charges by the charger 20. According to the static charge eliminator 3, the insulating film 11 may be charged such that the absolute value of the surface potential of the insulating film 11 is surely 30 kV or less. Therefore, the static charges imparted to the insulating film 11 by the charger 20 may be eliminated in a short time by the grounded needle-shaped conductor 30.

In the static charge eliminator 3 of the present embodiment, the insulating member (for example, the insulating member 21*a*) included in one or more (for example, the first charging unit 21) of the plurality of charging units (21, 22) may be made of a different material from the insulating member (for example, the insulating member 22*a*) included in the rest (for example, the second charging unit 22) of the plurality of charging units (21, 22). According to the static charge eliminator 3 of the present embodiment, even though both surfaces (the first surface 12 and the second surface 13) of the insulating film 11 are made of different materials from each other, the insulating film 11 may be charged such that the absolute value of the surface potential of the insulating film 11 is surely 3 kV or more and 30 kV or less.

For example, the first surface 12 of the insulating film 11 may be charged by bringing the insulating member (for example, the insulating member 21*a*) included in one or more (for example, the first charging unit 21) of the plurality of charging units (21, 22) into contact with the first surface 12 of the insulating film 11, and the second surface 13 of the insulating film 11 may be charged by bringing the insulating member (for example, the insulating member 22*a*) included in the rest (for example, the second charging unit 22) of the plurality of charging units (21, 22) into contact with the second surface 13 of the insulating film 11. The insulating member (for example, the insulating member 21*a*) included in one or more (for example, the first charging unit 21) of the plurality of charging units (21, 22) is made of a different material from the insulating member (for example, the insulating member 22*a*) included in the rest (for example, the second charging unit 22) of the plurality of charging units (21, 22). Therefore, according to the static charge eliminator 3, even though both surfaces (the first surface 12 and the second surface 13) of the insulating film 11 are made of different materials from each other, the insulating film 11 may be charged such that the absolute value of the surface potential of the insulating film 11 is surely 3 kV or more and 30 kV or less. Therefore, it is possible for the static charge eliminator 3 to reliably eliminate the static charges on the insulating film 11 in a short time.

Figure 7:
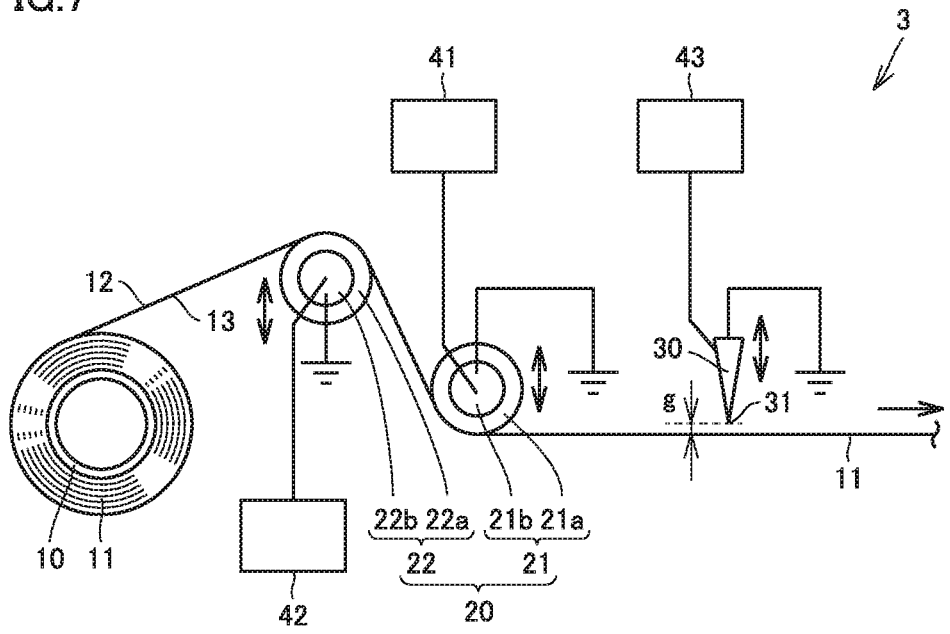
FIG. 7 is a schematic view illustrating a static charge eliminator according to a third embodiment of the present invention.
Figure 8:
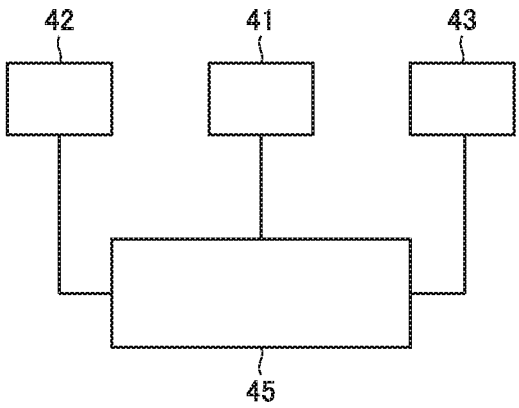
FIG. 8 is a block diagram illustrating an exemplar configuration of a controller included in the static charge eliminator according to the third embodiment of the present invention.

With reference to FIGS. 7 and 8, the static charge eliminator 3 of the present embodiment further includes a third drive unit 43 and a controller 45. The third drive unit 43 is configured to move the needle-shaped conductor 30 in a direction crossing a surface (at least one of the first surface 12 and the second surface 13) of the insulating film 11. Specifically, the third drive unit 43 may be configured to move the needle-shaped conductor 30 in a direction orthogonal to the first surface 12 of the insulating film 11. The controller 45 is configured to maintain a gap g between the needle-shaped conductor 30 and the insulating film 11. Specifically, the controller 45 may control the third drive unit 43 so as to maintain the gap g between the needle-shaped conductor 30 and the insulating film 11.

In the static charge elimination method of the present embodiment, generating a corona discharge including controlling the position of the needle-shaped conductor 30 relative to the insulating film 11 so as to maintain the gap g between the needle-shaped conductor 30 and the insulating film 11. Since the gap g between the needle-shaped conductor 30 and the insulating film 11 is maintained by the control section 45, it is possible for the grounded needle-shaped conductor 30 to stably and reliably eliminate the static charges on the insulating film 11.

The controller 45 may be further connected to a drive unit (for example, the first drive unit 41, the second drive unit 42) configured to move one or more charging units (21, 22). The gap g between the needle-shaped conductor 30 and the insulating film 11 may change along with the moving distance of one or more charging units (21, 22) by the drive unit (for example, the first drive unit 41, the second drive unit 42). Thus, the controller 45 moves the needle-shaped conductor 30 so as to compensate for the change in the gap g. In this way, the controller 45 can maintain the gap g between the needle-shaped conductor 30 and the insulating film 11.

In addition to the effects of the static charge eliminator 1 of the first embodiment, the static charge eliminator 3 of the present embodiment provide the following effects.

In the static charge eliminator 3 of the present embodiment, at least one of the one or more charging units (21, 22) is configured such that at least one of the contact pressure and the contact length between the insulating member 21*a*, 22*a* and the insulating film 11 is changed. According to the static charge eliminator 3 of the present embodiment, the static charges on the insulating film 11 can be reliably eliminated.

In the static charge eliminator 3 of the present embodiment, the insulating members 21*a* and 22*a* are configured to be movable in a direction crossing a surface (at least one of the first surface 12 and the second surface 13) of the insulating film 11. Therefore, the insulating film 11 may be charged while being conveyed. According to the static charge eliminator 3 of the present embodiment, the static charges on the insulating film 11 can be reliably eliminated in a short time.

In the static charge eliminator 3 of the present embodiment, the insulating member (for example, the insulating member 21*a*) included in one or more (for example, the first charging unit 21) of the plurality of charging units (21, 22) may be made of a different material from the insulating member (for example, the insulating member 22*a*) included in the rest (for example, the second charging unit 22) of the plurality of charging units (21, 22). Therefore, even though both surfaces (the first surface 12 and the second surface 13) of the insulating film 11 are made of different materials from each other, the insulating film 11 may be charged such that the absolute value of the surface potential of the insulating film 11 is surely 3 kV or more.

The static charge eliminator 3 of the present embodiment may further include a controller 45. The controller 45 may be configured to maintain the gap g between the needle-shaped conductor 30 and the insulating film 11. According to the static charge eliminator 3 of the present embodiment, it is possible for the grounded needle-shaped conductor 30 to stably and reliably eliminate the static charges on the insulating film 11.

In the static charge elimination method of the present embodiment, charging the insulating film 11 includes changing at least one of the contact pressure and the contact length between the insulating member 21*a*, 22*a* and the insulating film 11. According to the static charge elimination method of the present embodiment, the static charges on the insulating film 11 can be reliably eliminated.

In the static charge elimination method of the present embodiment, generating a corona discharge including controlling the position of the needle-shaped conductor 30 relative to the insulating film 11 so as to maintain the gap g between the needle-shaped conductor 30 and the insulating film 11. According to the static charge elimination method of the present embodiment, it is possible for the grounded needle-shaped conductor 30 to stably and reliably eliminate the static charges on the insulating film 11.

Fourth Embodiment

Figure 9:
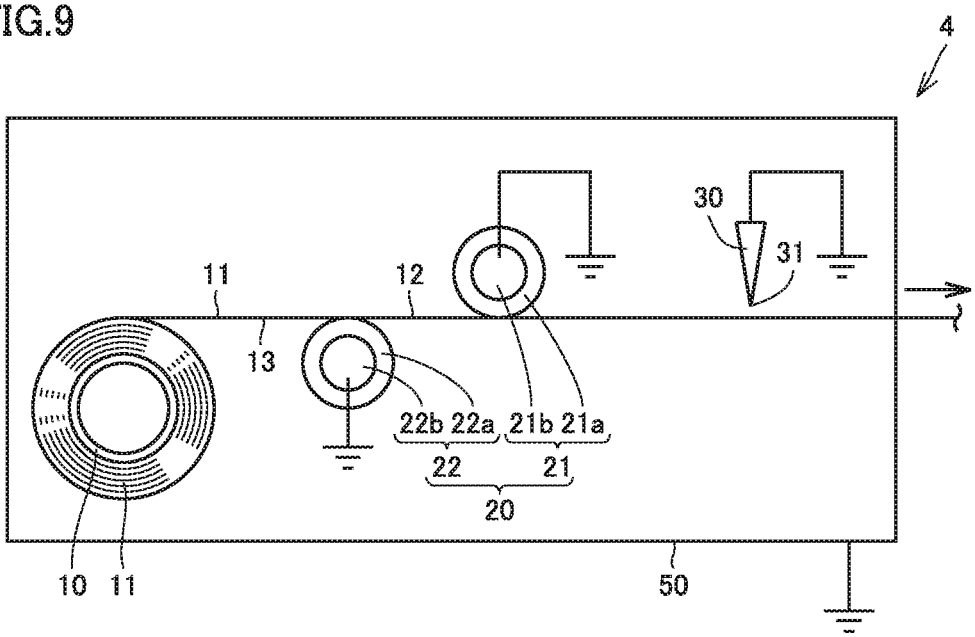
FIG. 9 is a schematic view illustrating a static charge eliminator according to a fourth embodiment of the present invention.

A static charge eliminator 4 according to a fourth embodiment will be described with reference to FIG. 9. The static charge eliminator 4 of the present embodiment has substantially the same configuration as the static charge eliminator 1 of the first embodiment except the following points.

The static charge eliminator 4 of the present embodiment further includes a conductive case 50 containing the charger 20 and the needle-shaped conductors 30. The conductive case 50 is not particularly limited, it may be made of a conductive metal such as aluminum, stainless steel or iron, or an conductive resin sheet subjected to an antistatic treatment.

The conductive case 50 is configured to confine therein ions generated by the corona discharge between the needle-shaped conductor 30 and the insulating film 11. The ions generated by the corona discharge between the needle-shaped conductor 30 and the insulating film 11 may be used to reliably eliminate the static charges on the insulating film 11.

The conductive case 50 may be grounded. When the insulating film 11 is unwound from the bobbin 10, the insulating film 11 is peeled off from the adjacent insulating film 11 or rubs against the adjacent insulating film 11. Thereby, the insulating film 11 is charged. When the insulating members 21*a* and 22*a* are brought into contact with the insulating film 11, the insulating members 21*a* and 22*a* are charged accordingly. The grounded conductive case 50 can prevent foreign matters such as dust from being adhered to the charged insulating film 11 and the charged insulating members 21*a*, 22*a*.

In addition to the effects of the static charge eliminator 1 of the first embodiment, the static charge eliminator 4 of the present embodiment provide the following effects.

The static charge eliminator 4 of the present embodiment further includes a conductive case 50 containing the charger 20 and the needle-shaped conductors 30. The conductive case 50 confines the ions generated by the corona discharge between the needle-shaped conductor 30 and the insulating film 11. According to the static charge eliminator 4 of the present embodiment, the static charges on the insulating film 11 may be reliably eliminated in a short time.

Fifth Embodiment

Figure 10:
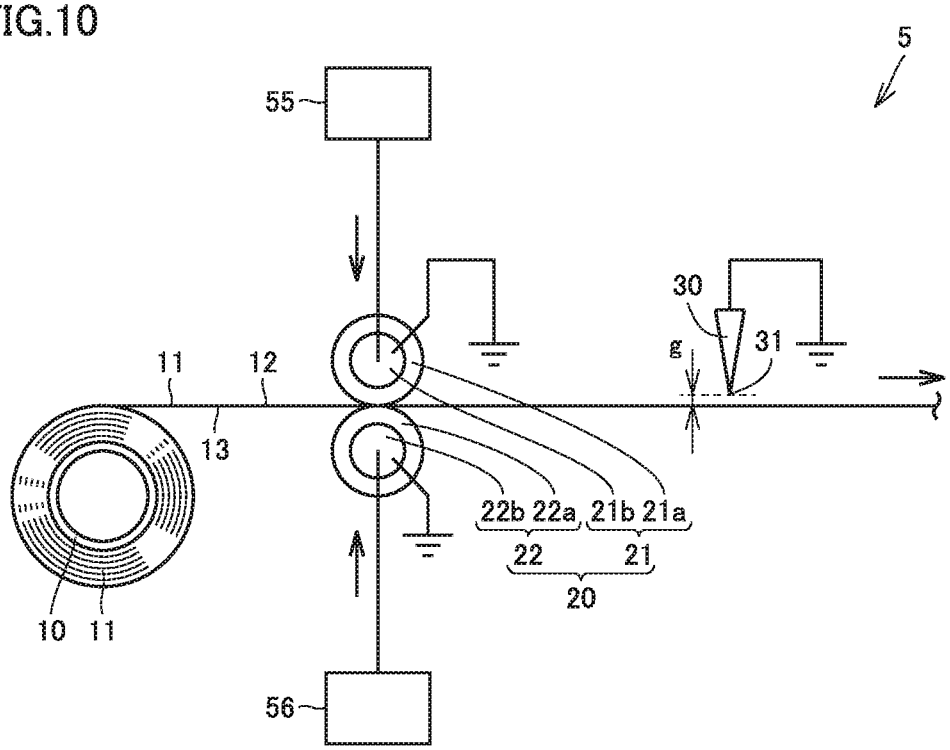
FIG. 10 is a schematic view illustrating a static charge eliminator according to a fifth embodiment of the present invention.

A static charge eliminator 5 according to a fifth embodiment will be described with reference to FIG. 10. The static charge eliminator 5 of the present embodiment has substantially the same configuration as the static charge eliminator 1 of the first embodiment except the following points.

In the static charge eliminator 5 of the present embodiment, the plurality of charging units (the first charging unit 21 and the second charging unit 22) are configured to sandwich the insulating film 11 with the plurality of rollers 21*b* and 22*b* covered respectively by the insulating members 21*a* and 22*a*. The insulating film 11 is sandwiched between the insulating member 21*a* and the insulating member 22*a*. Specifically, the static charge eliminator 5 may further include pressing members 55 and 56. The pressing member 55 is configured to press the first charging unit 21 against the insulating film 11, and the pressing member 56 is configured to press the second charging unit 22 against the insulating film 11. The pressing members 55 and 56 each may be, for example, a biasing member such as a spring or a pressing machine.

In the static charge elimination method of the present embodiment, charging the insulating film 11 includes bringing the insulating members 21*a*, 22*a* into contact with the surfaces (the first surface 12 and the second surface 13) of the insulating film 11 by sandwiching the insulating film 11 with a plurality of rollers 21*b*, 22*b* covered respectively by the insulating members 21*a*, 22*a*. Specifically, the pressing member 55 presses the first charging unit 21 against the insulating film 11, and the pressing member 56 presses the second charging unit 22 against the insulating film 11. In this way, the insulating film 11 may be sandwiched by the plurality of rollers 21*b*, 22*b* covered respectively by the insulating members 21*a*, 22*a*. The insulating film 11 may be sandwiched between the insulating member 21*a* and the insulating member 22*a*.

In addition to the effects of the static charge eliminator 1 and the static charge elimination method of the first embodiment, the static charge eliminator 5 and the static charge elimination method of the present embodiment provide the following effects.

In the static charge eliminator 5 of the present embodiment, the plurality of charging units (the first charging unit 21 and the second charging unit 22) are configured to sandwich the insulating film 11 with the plurality of rollers 21*b* and 22*b* covered respectively by the insulating members 21*a* and 22*a*. Therefore, even though wrinkles are present on the insulating film 11, the insulating members 21*a* and 22*a* may be ensured to contact all the surfaces (the first surface 12 and the second surface 13) of the insulating film 11. According to the static charge eliminator 5 of the present embodiment, the surfaces (the first surface 12 and the second surface 13) of the insulating film 11 may be charged such that the absolute value of the surface potential of each surface (the first surface 12, the second surface 13) of the insulating film 11 is surely 3 kV.

In the static charge elimination method of the present embodiment, the charger 20 (the first charging unit 21, the second charging unit 22) includes a plurality of rollers 21*b*, 22*b* covered respectively by the insulating members 21*a*, 22*a*. Charging the insulating film 11 includes bringing the insulating members 21*a*, 22*a* into contact with the surfaces (the first surface 12 and the second surface 13) of the insulating film 11 by sandwiching the insulating film 11 with a plurality of rollers 21*b*, 22*b* covered respectively by the insulating members 21*a*, 22*a*. Therefore, even though wrinkles are present on the insulating film 11, the insulating members 21*a* and 22*a* may be ensured to contact all the surfaces (the first surface 12 and the second surface 13) of the insulating film 11. According to the static charge elimination method of the present embodiment, the surfaces (the first surface 12 and the second surface 13) of the insulating film 11 may be charged such that the absolute value of the surface potential of each surface (the first surface 12, the second surface 13) of the insulating film 11 is surely 3 kV.

The first to fifth embodiments and the modification of the first embodiment disclosed herein are merely examples in all aspects and not limited thereto. At least two of the first to fifth embodiments disclosed herein may be carried out in any combined appropriately as long as they are not contradictory to each other. For example, the static charge eliminator 1, 1*b*, 2, 4, 5 of the first, second, fourth, fifth embodiment and the modification of the first embodiment may include the controller 45 described in the third embodiment and configured to maintain the gap g between the needle-shaped conductor 30 and the insulating film 11. The static charge eliminator 1, 1*b*, 2, 3, 5 of the first, second, third, fifth embodiment and the modification of the first embodiment may include the conductive case 50 described in the fourth embodiment. The scope of the present invention is defined by the terms of the claims, rather than the description above, and is intended to include any modifications within the meaning and scope equivalent to the terms of the claims.

REFERENCE SIGNS LIST

1, 1*b*, 2, 3, 4, 5: static charge eliminator; 10: bobbin; 11: insulating film; 12: first surface; 13: second surface; 20: charger; 21: first charging unit; 21*a*, 22*a*, 23*a*: insulating member; 21*b*, 22*b*, 23*b*: roller; 22: second charging unit; 23: third charging unit; 30: needle-shaped conductor; 31: tip; 41: first drive unit; 42: second drive unit; 43: third drive unit; 45: controller; 50: conductive case; 55, 56: pressing member

The invention claimed is:

1. A static charge eliminator comprising:

a charger including one or more charging units; and a grounded needle-shaped conductor, wherein the charger being configured to charge an insulating film by contacting the insulating film such that an absolute value of a surface potential of the insulating film is 3 kV or more, each of the one or more charging units includes a roller covered by an insulating member having a different level in a triboelectric series from the insulating film, the insulating member is configured to contact a surface of the insulating film, and a needle-shaped conductor is arranged to generate a corona discharge between the insulating film charged by the charger and the needle-shaped conductor.

2. The static charge eliminator according to claim 1, wherein the one or more charging units are a plurality of the charging units.

3. The static charge eliminator according to claim 2, wherein the surface of the insulating film includes one surface of the insulating film and the other surface thereof opposite to the one surface, at least one of the plurality of charging units is configured to face the one surface, and the rest of the plurality of charging units is configured to face the other surface.

4. The static charge eliminator according to claim 3, wherein the insulating member included in the at least one of the plurality of charging units is made of a different material from the insulating member included in the rest of the plurality of charging units.

5. The static charge eliminator according to claim 2, wherein at least one of the plurality of charging units is configured to be switchable between a first state in which the at least one of the plurality of charging units charges the insulating film and a second state in which the at least one of the plurality of charging units imparts no static charge to the insulating film.

6. The static charge eliminator according to claim 2, wherein at least one of the plurality of charging units is configured such that at least one of a contact pressure and a contact length between the insulating member and the insulating film is changed.

7. The static charge eliminator according to claim 5, wherein the insulating member is configured to be movable in a direction crossing the surface of the insulating film.

8. The static charge eliminator according to claim 5, wherein the insulating member included in the at least one of the plurality of charging units is made of a different material from the insulating member included in the rest of the plurality of charging units.

9. The static charge eliminator according to claim 2, wherein the plurality of charging units are configured to sandwich the insulating film with a plurality of the rollers each covered by the insulating member.

10. The static charge eliminator according to claim 1, further comprising a conductive case containing the charger and the needle-shaped conductor.

11. A static charge elimination method comprising:

charging an insulating film by bringing a charger into contact with a surface of the insulating film such that an absolute value of a surface potential of the insulating film is 3 kV or more; and generating a corona discharge between a grounded needle-shaped conductor and the charged insulating film, wherein the charging the insulating film includes bringing a roller covered by an insulating member having a different level in a triboelectric series from the insulating film into contact with the surface of the insulating film.

12. The static charge elimination method according to claim 11, wherein the charging the insulating film includes changing at least one of a contact pressure and a contact length between the insulating member and the insulating film.

13. The static charge elimination method according to claim 11, wherein the charger includes a plurality of the rollers each covered by the insulating member, and the charging the insulating film includes bringing the insulating member into contact with the surface of the insulating film by sandwiching the insulating film with the plurality of rollers each covered by the insulating member.

14. The static charge elimination method according to claim 11, wherein the generating the corona discharge includes controlling the position of the needle-shaped conductor relative to the insulating film so as to maintain a gap between the needle-shaped conductor and the insulating film.

* * * * *